US011645977B2

(12) United States Patent
Chen et al.

(10) Patent No.: US 11,645,977 B2
(45) Date of Patent: May 9, 2023

(54) PIXEL CIRCUIT, DISPLAY PANEL, DISPLAY DEVICE AND DRIVING METHOD

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Shuai Chen, Beijing (CN); Xiuzhu Tang, Beijing (CN); Zhi Zhang, Beijing (CN); Taoliang Tang, Beijing (CN); Qian Qian, Beijing (CN); Xuebo Liang, Beijing (CN); Zhenguo Tian, Beijing (CN); Xing Dong, Beijing (CN); Lijun Xiong, Beijing (CN); Qian Wang, Beijing (CN); Cuilian Li, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 138 days.

(21) Appl. No.: 17/256,183

(22) PCT Filed: Apr. 21, 2020

(86) PCT No.: PCT/CN2020/085960
§ 371 (c)(1),
(2) Date: Dec. 25, 2020

(87) PCT Pub. No.: WO2020/238490
PCT Pub. Date: Dec. 3, 2020

(65) Prior Publication Data

US 2021/0272517 A1 Sep. 2, 2021

(30) Foreign Application Priority Data

May 31, 2019 (CN) ..... 201910467383.6

(51) Int. Cl.
*G09G 3/3241* (2016.01)

(52) U.S. Cl.
CPC ... *G09G 3/3241* (2013.01); *G09G 2300/0833* (2013.01); *G09G 2300/0857* (2013.01); *G09G 2310/08* (2013.01)

(58) Field of Classification Search
None
See application file for complete search history.

(56) References Cited

U.S. PATENT DOCUMENTS 9,508,274 B2 11/2016 Ro et al.
2008/0117345 A1 5/2008 Ishii et al.
(Continued)

FOREIGN PATENT DOCUMENTS

CN 101276533 A 10/2008
CN 101630479 B 9/2012
(Continued)

OTHER PUBLICATIONS

International search report of PCT application No. PCT/CN2020/085960 dated Jul. 8, 2020.
(Continued)

*Primary Examiner* — Aneeta Yodichkas
(74) *Attorney, Agent, or Firm* — Lippes Mathias LLP

(57) ABSTRACT

A pixel circuit, a display substrate, a display device and a driving method are provided. The pixel circuit includes a data writing sub-circuit and a driving sub-circuit, and the data writing sub-circuit is connected to a scan signal terminal, a control signal terminal, a data signal terminal and a drive sub circuit. The data writing sub-circuit is used to output a data signal from the data signal terminal to the
(Continued)

control node in response to a control signal provided by the control signal terminal and a scan signal provided by the scan signal terminal. The driving sub-circuit is connected to the control node, a power signal terminal and a light-emitting element, respectively, and is used to drive the light-emitting element to emit light in response to a potential of the control node and a power signal provided by the power signal terminal.

20 Claims, 10 Drawing Sheets

(56) References Cited

U.S. PATENT DOCUMENTS

| | | | |
|---|---|---|---|
| 2008/0238854 | A1 | 10/2008 | Kimura |
| 2014/0055432 | A1 | 2/2014 | Yamamoto et al. |
| 2015/0161928 | A1 | 6/2015 | Kim et al. |
| 2018/0261150 | A1 | 9/2018 | Tamura |
| 2019/0371243 | A1 | 12/2019 | Yang et al. |

FOREIGN PATENT DOCUMENTS

| | | | |
|---|---|---|---|
| CN | 104123906 | A | 10/2014 |
| CN | 104700798 | A | 6/2015 |
| CN | 107342049 | A | 11/2017 |
| CN | 108037630 | A | 5/2018 |
| CN | 108573669 | A | 9/2018 |
| CN | 108986749 | A | 12/2018 |
| CN | 109389953 | A | 2/2019 |
| CN | 109767726 | A | 5/2019 |
| CN | 109767744 | A | 5/2019 |
| CN | 109961736 | A | 7/2019 |
| CN | 110111738 | A | 8/2019 |
| EP | 3667651 | A1 | 6/2020 |
| JP | 2007322747 | A | 12/2007 |

OTHER PUBLICATIONS

First office action of Chinese application No. 201910467383.6 dated Apr. 30, 2020.

Second office action of Chinese application No. 201910467383.6 dated Feb. 18, 2021.

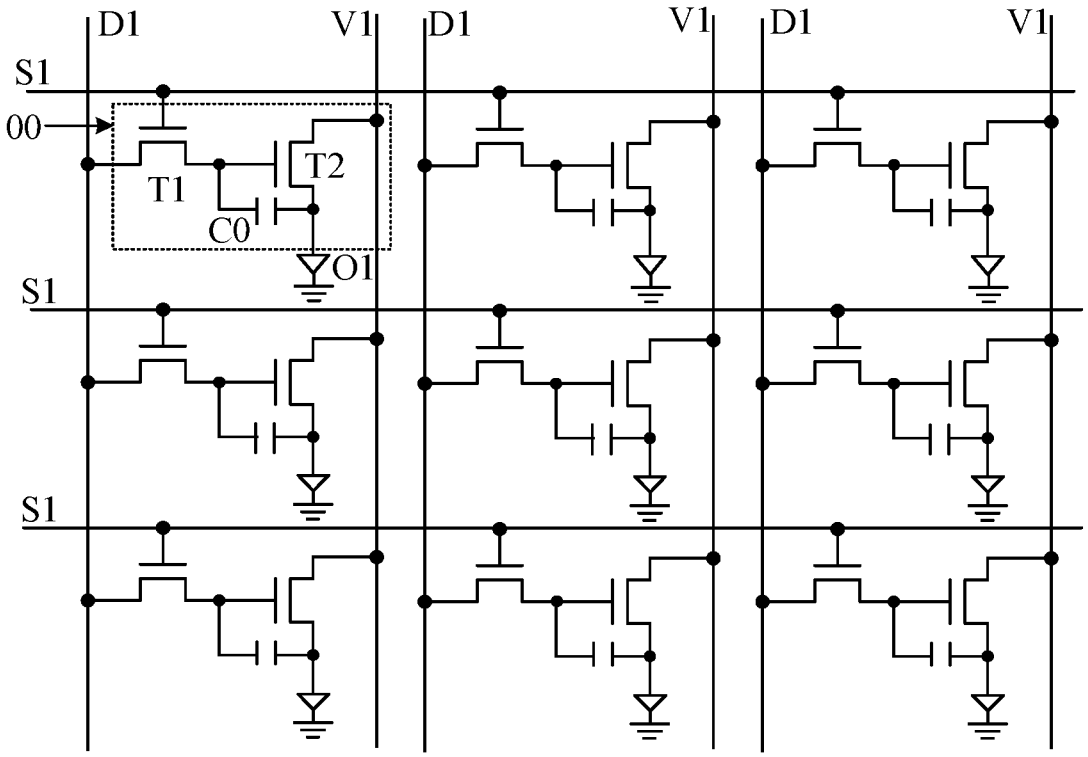
--Prior Art-- FIG. 1
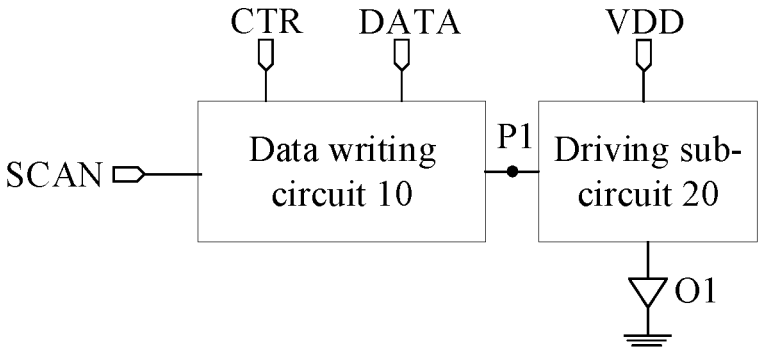
FIG. 2

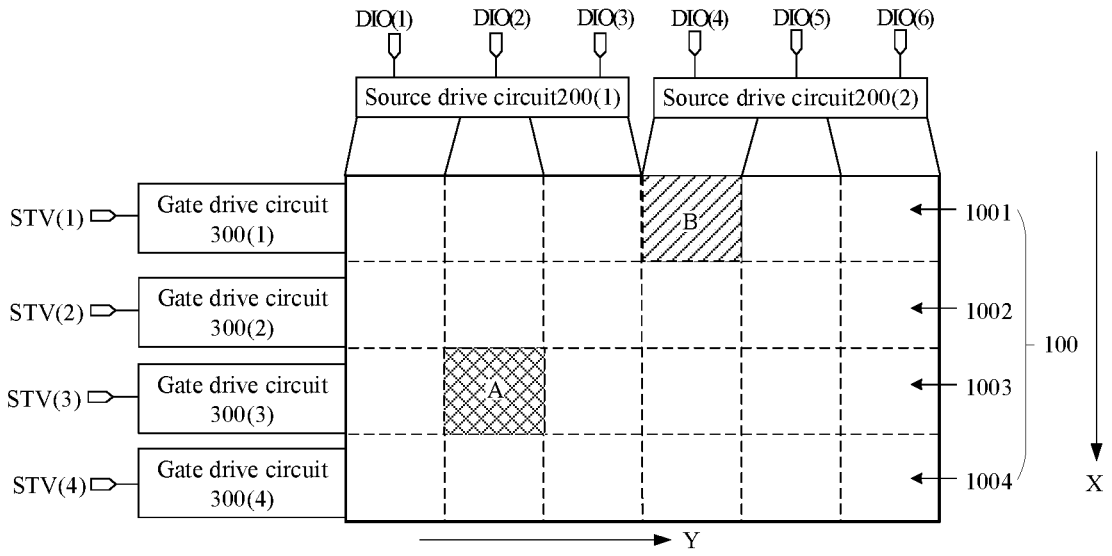
FIG. 11
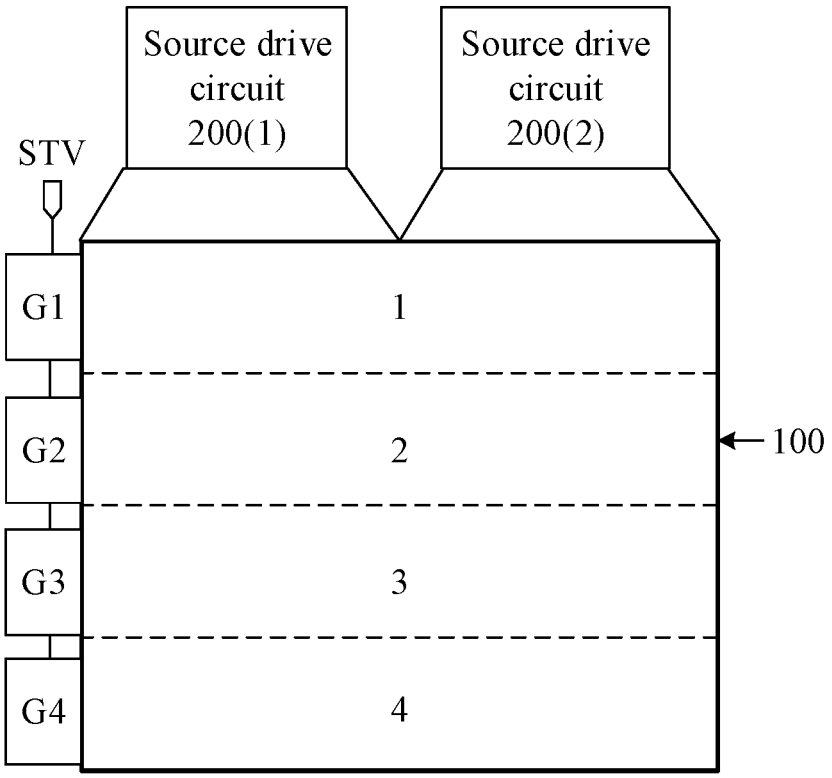
--Prior Art-- FIG. 12

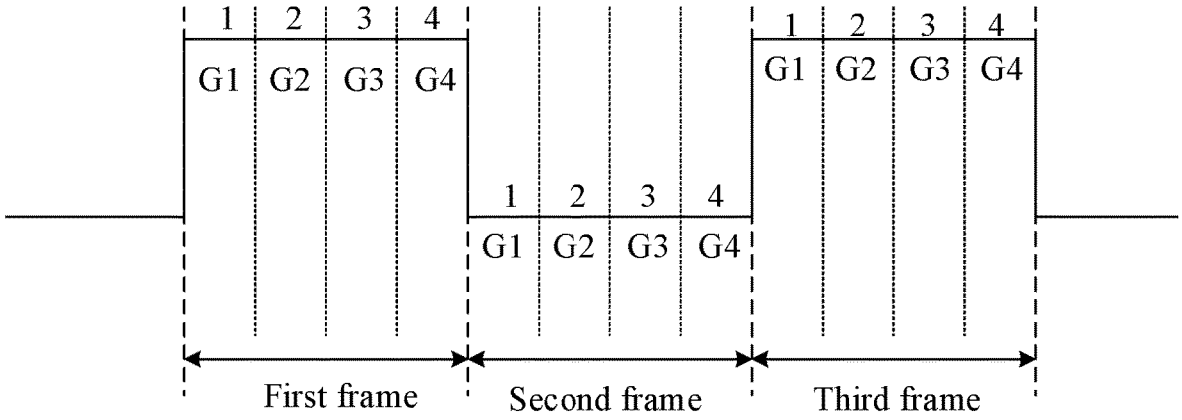
--Prior Art-- FIG. 13
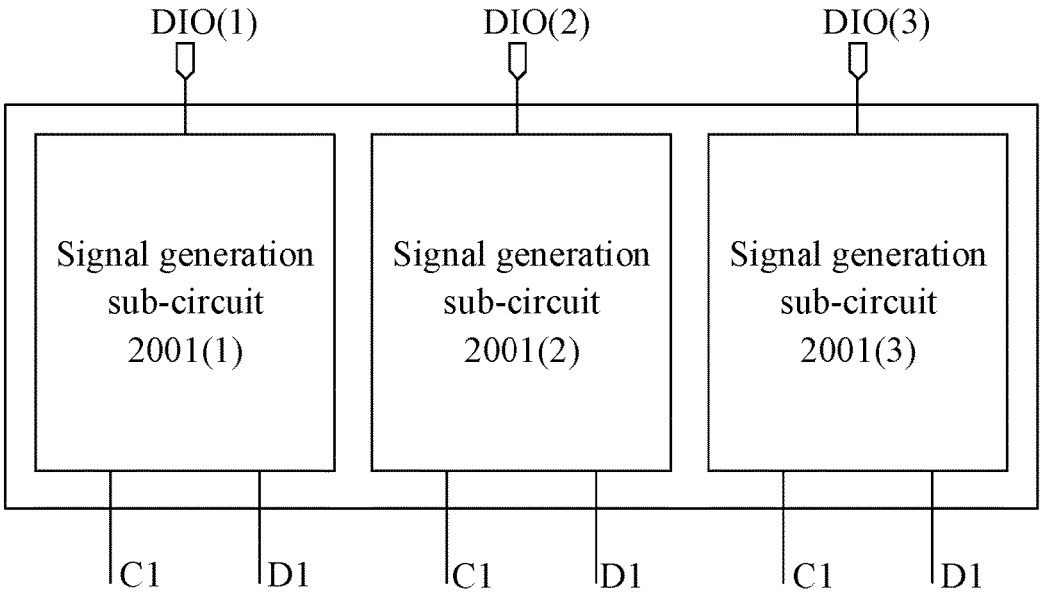
FIG. 14

PIXEL CIRCUIT, DISPLAY PANEL, DISPLAY DEVICE AND DRIVING METHOD

CROSS-REFERENCE TO RELATED APPLICATIONS

The present disclosure is a 371 of PCT Patent Application Serial No. PCT/CN2020/085960, filed on Apr. 21, 2020, which claims priority to Chinese Patent Application No. 201910467383.6, field on May 31, 2019 and entitled "PIXEL CIRCUIT, DISPLAY PANEL, DISPLAY DEVICE AND DRIVING METHOD", the entire contents of which are incorporated herein by reference.

TECHNICAL FIELD

The present disclosure relates to the field of display technologies, and in particular to a pixel circuit, a display substrate, a display device and a driving method.

BACKGROUND

Organic light-emitting diodes (OLEDs) have been widely used in high-performance display substrates due to their advantages such as lightweight and thin structure, self-luminescence, high contrast ratio and wide operating temperature range.

In the related art, an OLED display substrate includes a plurality of gate lines, a plurality of data lines, and a plurality of pixel units, with each pixel unit including a pixel circuit and a light-emitting element. Each gate line is connected to a row of the pixel units, and each data line is connected to a column of the pixel units. The pixel circuits in the individual pixel units can drive the light-emitting elements connected thereto according to data signals provided by the data lines, in response to gate drive signals provided by the gate lines.

SUMMARY

The present disclosure provides a pixel circuit, a display substrate, a display device and a driving method.

In an aspect, a pixel circuit is provided. The pixel circuit includes: a data writing sub-circuit and a driving sub-circuit, wherein the data writing sub-circuit is connected to a control signal terminal, a scan signal terminal, a data signal terminal and a control node, respectively, and is used to output a data signal from the data signal terminal to the control node, in response to a control signal provided by the control signal terminal and a scan signal provided by the scan signal terminal; and the driving sub-circuit is connected to the control node, a power signal terminal and a light-emitting element, respectively, and is used to drive the light-emitting element to emit light in response to a potential of the control node and a power signal provided by the power signal terminal.

Optionally, the data writing sub-circuit includes: a switch portion and a data writing portion, wherein the switch portion is connected to the control signal terminal, the scan signal terminal, and the data writing portion, respectively, and is used to output the scan signal to the data writing portion in response to the control signal; and the data writing portion is further connected to the data signal terminal and the control node, respectively, and is used to output the data signal to the control node in response to the scan signal.

Optionally, the switch portion includes: a first switch transistor, wherein a gate of the first switch transistor is connected to the control signal terminal; a first electrode of the first switch transistor is connected to the scan signal terminal; and a second electrode of the first switch transistor is connected to the data writing portion.

Optionally, the data writing portion includes: a second switch transistor, wherein a gate of the second switch transistor is connected to the switch portion; a first electrode of the second switch transistor is connected to the data signal terminal; and a second electrode of the second switch transistor is connected to the control node.

Optionally, the data writing sub-circuit includes: a switch portion and a data writing portion, wherein the switch portion is connected to the control signal terminal, the data signal terminal and the data writing portion, respectively, and is used to output the data signal to the data writing portion in response to the control signal; and the data writing portion is further connected to the scan signal terminal and the control node, respectively, and is used to output the data signal to the control node in response to the scan signal.

Optionally, the switch portion includes: a first switch transistor, wherein a gate of the first switch transistor is connected to the control signal terminal; a first electrode of the first switch transistor is connected to the data signal terminal; and a second electrode of the first switch transistor is connected to the data writing portion.

Optionally, the data writing portion includes: a second switch transistor, wherein a gate of the second switch transistor is connected to the scan signal terminal; a first electrode of the second switch transistor is connected to the switch portion; and a second electrode of the second switch transistor is connected to the control node.

Optionally, the driving sub-circuit includes: a drive transistor and a storage capacitor, wherein a gate of the drive transistor is connected to the control node, a first electrode of the drive transistor is connected to the power signal terminal, and a second electrode of the drive transistor is connected to the light emitting element; and one terminal of the storage capacitor is connected to the control node, and the other terminal of the storage capacitor is connected to the second electrode of the drive transistor.

In another aspect, a display substrate is provided. The display substrate includes: a plurality of gate lines, a plurality of data lines, a plurality of control signal lines, a plurality of power signal lines and a plurality of pixel units, wherein each of the pixel units includes: a light-emitting element, and the pixel circuit as described in the above aspect, which is connected to the light-emitting element; and each of the gate lines is connected to scan signal terminals of a row of the pixel circuits, each of the data lines is connected to data signal terminals of a column of the pixel circuits, each of the control signal lines is connected to control signal terminals of a column of the pixel circuits, and each of the power signal lines is connected to power signal terminals of a column of the pixel circuit.

Optionally, the display substrate includes the control signal lines having a number the same as the number of the data lines, and the control signal lines are disposed in parallel with the data lines.

Optionally, one control signal line and one data line, which are connected to each column of the pixel circuits, are located at the same side of the column of pixel circuits.

In yet another aspect, a method for driving a display substrate is provided and is used to drive the display substrate as described in the above aspect. The method includes:

providing scan signals in sequence to at least two gate lines connected to pixel circuits located in a target region to be refreshed;

providing a control signal to at least one control signal line connected to the pixel circuits located in the target region; and providing a data signal to at least one data line connected to the pixel circuits located in the target region.

In still another aspect, a display device is provided. The display device includes: the display substrate as described in above aspect, a source drive circuit and a gate drive circuit, wherein the gate drive circuit is connected to a plurality of gate lines in the display substrate, and is used to provide scan signals to the plurality of gate lines connected thereto; and the source drive circuit is connected to a plurality of data lines and a plurality of control signal lines in the display substrate, respectively, and is used to provide data signals to the plurality of data lines connected thereto, and to provide control signals to a plurality of control signal lines connected thereto.

Optionally, the display device includes a plurality of the gate drive circuits, wherein each of the gate drive circuits is connected to a switching-on signal terminal and a plurality of gate lines, respectively, and is used to provide scan signals in sequence to the plurality of gate lines connected thereto in response to a switching-on signal provided by the switching-on signal terminal connected thereto; and wherein different gate drive circuits are connected to different switching-on signal terminals, and different gate lines.

Optionally, the display device has a plurality of partitions, each of which includes a plurality of rows of pixel units; and the plurality of gate lines connected to each of the gate drive circuits are connected to a plurality of rows of the pixel units in one of the partitions.

Optionally, the source drive circuit includes: a plurality of signal generation sub-circuits, wherein each of the signal generation sub-circuits is respectively connected to a clock signal terminal, at least one of the control signal lines and at least one of the data lines, respectively, and is used to output a control signal to the control signal line connected thereto and output a data signal to the data line connected thereto, according to a clock signal provided by the clock signal terminal connected thereto;

wherein the different signal generation sub-circuits are connected to different clock signal terminals, different control signal lines, and different data lines.

Optionally, each of the signal generation sub-circuits is respectively connected to the clock signal terminal, a plurality of adjacent control signal lines in the display substrate, and a plurality of adjacent data lines in the display substrate.

Optionally, each of the signal generation sub-circuits including: a control signal generation portion and a data signal generation portion, wherein the control signal generation portion is connected to the clock signal terminal and at least one of the control signal lines, respectively, and is used to output control signals to the control signal lines connected thereto, according to the clock signal provided by the clock signal terminal connected thereto; and the data signal generation portion is connected to the clock signal terminal and at least one of the data lines, respectively, and is used to output data signals to the data line connected thereto, according to the clock signal provided by the clock signal terminal connected thereto.

Optionally, the control signal generation portion includes: a flip-flop and an amplifier, wherein the flip-flop is connected to the clock signal terminal and the amplifier, respectively, and the amplifier is connected to at least one of the control signal lines.

In still another aspect, a method for driving a display device is provided, and is used to drive the display device as described in above aspects. The method includes:

providing a clock signal to a clock signal terminal connected to a target signal generation sub-circuit, wherein the control signal line and the data line, which are connected to the target signal generation sub-circuit, are both connected to a pixel circuit located in a target region to be refreshed.

BRIEF DESCRIPTION OF DRAWINGS

FIG. 1 illustrates a schematic structural diagram of a display substrate according to the related art;

FIG. 2 illustrates a schematic structural diagram of a pixel circuit according to an embodiment of the present disclosure;

FIG. 11 illustrates a schematic structural diagram of a display device according to an embodiment of the present disclosure;

FIG. 12 illustrates a schematic structural diagram of a display device according to the related art;

FIG. 13 illustrates a drive timing diagram of a display device according to the related art;

FIG. 14 illustrates a schematic structural diagram of a source drive circuit according to an embodiment of the present disclosure;

DESCRIPTION OF EMBODIMENTS

Figure 3:
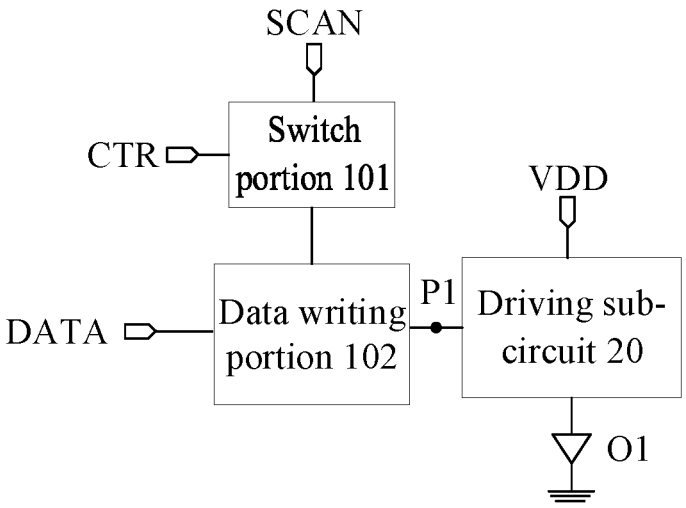
FIG. 3 illustrates a schematic structural diagram of another pixel circuit according to an embodiment of the present disclosure.

The embodiments of the present disclosure will be described in further detail with reference to the attached drawings, to more clearly present the objects, technical solutions, and advantages of the present disclosure.

The transistors used in all the embodiments of the present disclosure may include thin-film transistors or field-effect transistors or other apparatuses with the same characteristics. The transistors used in the embodiments of the present disclosure mainly include switch transistors according to their functions in a circuit. Sources and drains of the switch transistors used herein are symmetrical, and thus are interchangeable. In the embodiments of the present disclosure, a source therein is referred to as a first electrode and a drain is referred to as a second electrode; or, the drain therein is referred to as a first electrode and the source is referred to as a second electrode. Based on the forms in the accompanying drawings, an intermediate terminal of a transistor is defined as a gate, a signal input terminal as a source, and a signal output terminal as a drain. In addition, the switch transistors used in the embodiments of the present disclosure may include any one of a P-type switch transistor and an N-type switch transistor, wherein the P-type switch transistor is switched on when the gate is at a low level and switched off when the gate is at a high level; and the N-type switch transistor is switched on when the gate is at a high level, and is switched off when the gate is at a low level.

FIG. 1 illustrates a schematic structural diagram of a display substrate in the related art. As shown in FIG. 1, the display substrate includes a plurality of gate lines S1, a plurality of data lines D1, a plurality of power signal lines V1, a plurality of pixel circuits 00, and light-emitting elements O1 connected to the respective pixel circuits 00. For example, FIG. 1 schematically illustrates three gate lines S1, three data lines D1, three power signal lines V1, and nine pixel circuits 00 arranged in an array.

Referring to FIG. 1, each pixel circuit 00 may include a switch transistor T1, a drive transistor T2, and a storage capacitor C0 (that is, each pixel circuit 00 may have a 2T1C structure). The switch transistors T1 have gates that may be connected to the gate lines S1, first electrodes that may be connected to the data lines D1, and second electrodes that may be connected to gates of the drive transistors T2. The drive transistors T2 have first electrodes that may be connected to the power signal lines V1, and second electrodes that may be connected to the light-emitting elements O1. Each storage capacitor C0 has one terminal that may be connected to the gate of the corresponding drive transistor T2, and the other terminal that may be connected to the second electrode of the corresponding drive transistor T2. The switch transistors T1 may output data signals provided by the data lines D1 connected thereto to the gates of the drive transistors T2 when the gate lines S1 connected thereto provide scan signals. The drive transistors T2 may output drive currents to the light-emitting elements O1 connected thereto according to the data signals and the power signals provided by the power signal lines V1 connected thereto, so as to drive the light-emitting elements O1 to emit light. The storage capacitors C0 may be used to store the data signals.

In the display substrate, the switch transistors T1 included in the pixel circuits 00 have the gates directly connected to the gate lines S1, and the first electrodes directly connected to the data lines D1. Therefore, if one gate line S1 provides a scan signal, the respective switch transistors T1 included in one row of pixel circuits 00 connected to this gate line S1 may be switched on directly; and the respective switch transistors T1 included in the row of pixel circuits 00 may also output the data signals provided by the data line D1 to the gates of the respective drive transistors T2 included in this row of pixel circuits 00. Then, the respective drive transistors T2 included in this row of pixel circuits 00 may drive the light-emitting elements O1 connected thereto to emit light. However, since the plurality of gate lines S1 in the display substrate provide scan signals in sequence, the display substrate must be refreshed in full screen even when only a partial region of the display substrate needs to be updated, leading to high power consumption and low drive flexibility.

An embodiment of the present disclosure provides a pixel circuit, and a display substrate including the pixel circuit may enable image refreshing of the partial region. FIG. 2 illustrates a schematic structural diagram of a pixel circuit according to an embodiment of the present disclosure. As shown in FIG. 2, the pixel circuit includes: a data writing sub-circuit 10 and a driving sub-circuit 20.

The data writing sub-circuit 10 may be connected to a control signal terminal CTR, a scan signal terminal SCAN, a data signal terminal DATA and a control node P1. The data writing sub-circuit 10 may output a data signal from the data signal terminal DATA to the control node P1 in response to a control signal provided by the control signal terminal CTR and a scan signal provided by the scan signal terminal SCAN.

As an example, the data writing sub-circuit 10 may output the data signal from the data signal terminal DATA to the control node P1 when a potential of the control signal provided by the control signal terminal CTR and a potential of the scan signal provided by the scan signal terminal SCAN are both effective potentials.

The driving sub-circuit 20 may be connected to the control node P1, the power signal terminal VDD, and the light emitting element O1, respectively. The driving sub-circuit 20 may drive the light-emitting element O1 to emit light in response to the potential of the control node P1 and the power signal provided by the power signal terminal VDD.

As an example, when the data writing sub-circuit 10 outputs a data signal to the control node P1, the driving sub-circuit 20 may output a drive current to the light-emitting diode O1 to drive the light-emitting element O1 to emit light, according to the potential of the control node P1 (i.e., the potential of the data signal) and the power signal provided by the power signal terminal VDD.

The data writing sub-circuit 10 in the pixel circuit may output the data signal to the control node P1 only in response to the control signal and the scan signal. Therefore, even if the scan signal terminal provides scan signals in sequence, the potential of the control signal provided by the control signal terminal CTR may be controlled, so that only the pixel circuits located in the target region of an image to be refreshed may drive the light-emitting element O1 connected thereto to emit light, while the pixel circuits located in a region outside the target region may not drive the light-emitting element O1 connected thereto to emit light, thereby enabling the image refreshing of the partial region.

In summary, the embodiments of the present disclosure provide a pixel circuit. The pixel circuit includes a data writing sub-circuit and a driving sub-circuit, and the data writing sub-circuit is connected to a scan signal terminal, a control signal terminal, a data signal terminal and a drive sub circuit. The data writing sub-circuit may output a data signal to the driving sub-circuit only in response to a scan signal provided by the scan signal terminal and a control signal provided by the control signal terminal. Therefore, only the pixel circuit located in a region of an image to be refreshed can drive a light-emitting element connected thereto to emit light by controlling a potential of the control signal, thereby refreshing an image of a partial region, and reducing the power consumption. The pixel circuit according to the embodiments of the present disclosure is high in drive flexibility, and effectively improves the flexibility in image refreshing.

FIG. 3 illustrates a schematic structural diagram of another pixel circuit according to an embodiment of the present disclosure. As an optional implementation, as shown in FIG. 3, the data writing sub-circuit 10 may include: a switch portion 101 and a data writing portion 102.

The switch portion 101 may be connected to a control signal terminal CTR, a scan signal terminal SCAN and a data writing portion 102, respectively. The switch portion 101 may output a scan signal to the data writing portion 102 in response to the control signal.

As an example, the switch portion 101 may output the scan signal to the data writing portion 102 when the control signal has an effective potential.

The data writing unit 102 may also be connected to a data signal terminal DATA and a control node P1, respectively. The data writing portion 102 may output a data signal to the control node P1 in response to the scan signal.

As an example, the data writing portion 102 may output a data signal to the control node P1 when a scan signal outputted to the data writing portion 102 by the switch portion 101 has an effective potential.

Figure 4:
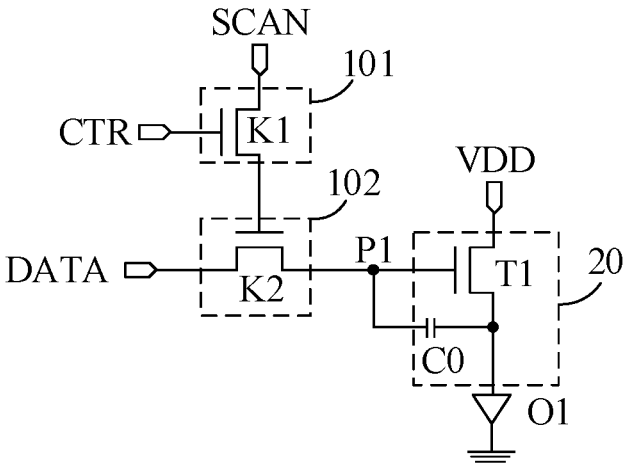
FIG. 4 illustrates a schematic structural diagram of yet another pixel circuit according to an embodiment of the present disclosure.

FIG. 4 illustrates a schematic structural diagram of yet another pixel circuit according to an embodiment of the present disclosure. As shown in FIG. 4, the switch portion 101 may include: a first switch transistor K1. The data writing portion 102 may include: a second switch transistor K2.

A gate of the first switch transistor K1 may be connected to the control signal terminal CTR, a first electrode of the first switch transistor K1 may be connected to the scan signal terminal SCAN, and a second electrode of the first switch transistor K1 may be connected to a gate of the second switch transistor K2.

A first electrode of the second switch transistor K2 may be connected to the data signal terminal DATA, and a second electrode of the second switch transistor K2 may be connected to the control node P1.

Figure 5:
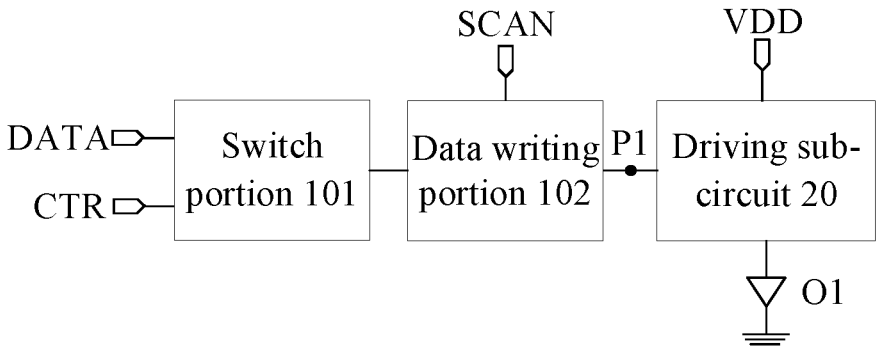
FIG. 5 illustrates a schematic structural diagram of still another pixel circuit according to an embodiment of the present disclosure.

FIG. 5 illustrates a schematic structural diagram of still another pixel circuit according to an embodiment of the present disclosure. As another optional implementation, as shown in FIG. 5, the data writing sub-circuit 10 may include: a switch portion 101 and a data writing portion 102.

The switch portion 101 may be connected to a control signal terminal CTR, a data signal terminal DATA and a data writing portion 102, respectively. The switch portion 101 may output a data signal to the data writing portion 102 in response to the control signal.

As an example, the switch portion 101 may output the data signal to the data writing portion 102 when the control signal has an effective potential.

The data writing portion 102 may also be connected to a scan signal terminal SCAN and a control node P1, respectively. The data writing portion 102 may output a data signal to the control node P1 in response to the scan signal.

As an example, the data writing portion 102 may output the data signal to the control node P1 when the scan signal has an effective potential.

Figure 6:
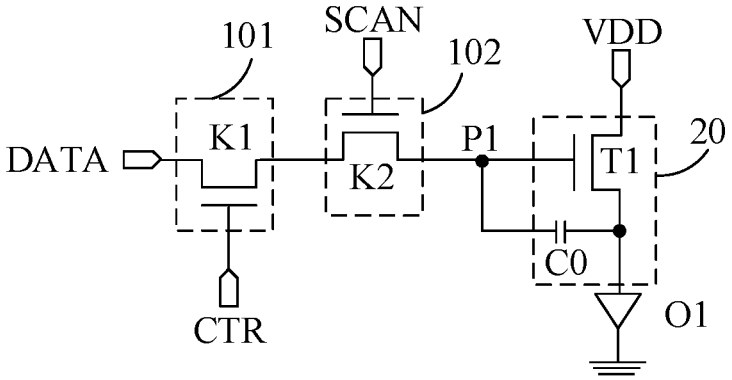
FIG. 6 illustrates a schematic structural diagram of still another pixel circuit according to an embodiment of the present disclosure.

FIG. 6 illustrates a schematic structural diagram of still another pixel circuit according to an embodiment of the present disclosure. As shown in FIG. 6, the switch portion 101 may include: a first switch transistor K1. The data writing portion 102 may include: a second switch transistor K2.

A gate of the first switch transistor K1 may be connected to a control signal terminal CTR, a first electrode of the first switch transistor K1 may be connected to a data signal terminal DATA, and a second electrode of the first switch transistor K1 may be connected to a first electrode of a second switch transistor K2.

A gate of the second switch transistor K2 may be connected to a scan signal terminal SCAN, and a second electrode of the second switch transistor K2 may be connected to a control node P1.

Optionally, referring to FIG. 4 and FIG. 6, a driving sub-circuit 20 according to the embodiments of the present disclosure may include: a drive transistor T1 and a storage capacitor C0.

A gate of the drive transistor T1 may be connected to the control node P1, a first electrode of the drive transistor T1 may be connected to a power signal terminal VDD, and a second electrode of the drive transistor T1 may be connected to a light-emitting element O1.

One terminal of the storage capacitor C0 may be connected to the control node P1, and the other terminal of the storage capacitor C0 may be connected to the second electrode of the drive transistor T1. In the embodiments of the present disclosure, the storage capacitor C0 may store a data signal outputted to the control node P1.

It should be noted that the respective foregoing embodiments are described by using N-type transistors as the respective transistors in a pixel circuit, and an effective potential is a high potential with respect to an ineffective potential, by way of example. Of course, P-type transistors may also be used as the respective transistors in a shift register unit. When the P-type transistors are used as the respective transistors, the effective potential may be a low potential with respect to the ineffective potential.

In summary, the embodiments of the present disclosure provide a pixel circuit. The pixel circuit includes a data writing sub-circuit and a driving sub-circuit, and the data writing sub-circuit is connected to a scan signal terminal, a control signal terminal, a data signal terminal and a drive sub circuit. The data writing sub-circuit may output a data signal to the driving sub-circuit only in response to a scan signal provided by the scan signal terminal and a control signal provided by the control signal terminal. Therefore, only the pixel circuit located in a region of an image to be refreshed can drive a light-emitting element connected thereto to emit light by controlling a potential of the control signal, thereby refreshing the image of a partial region. The pixel circuit according to the embodiments of the present disclosure is high in drive flexibility, and thus effectively improves the flexibility in image refreshing.

Figure 7:
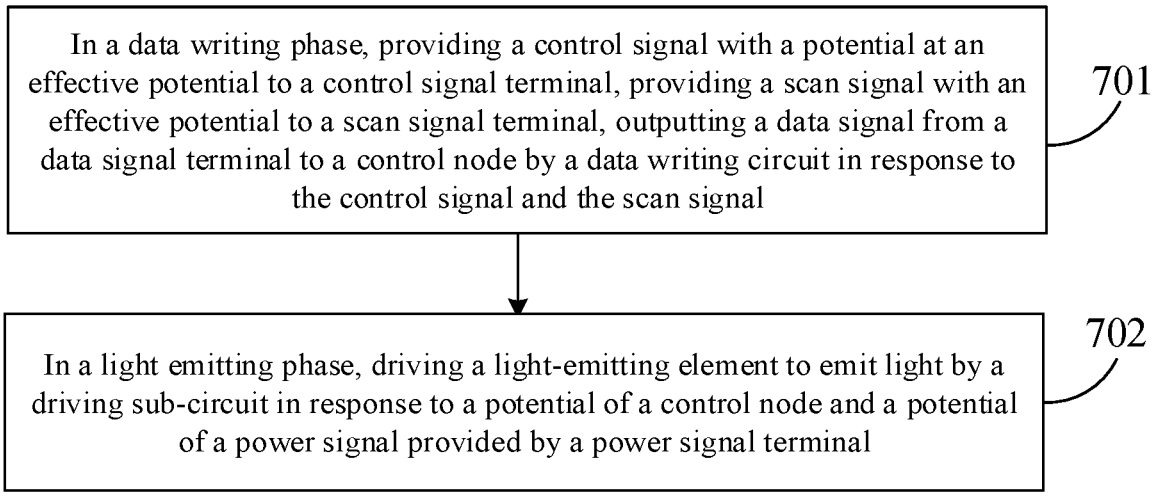
FIG. 7 illustrates a flowchart of a method for driving a pixel circuit according to an embodiment of the present disclosure.

The embodiments of the present disclosure also provide a method for driving the above-mentioned pixel circuit. Taking the pixel circuit shown in any one of FIGS. 2 to 4 as an example, a method for driving the pixel circuit is introduced using the N-type transistors as the respective transistors in the pixel circuit, by way of example. As shown in FIG. 7, the method may include the following steps.

In step 701, in a data writing phase, a control signal with a potential at an effective potential is provided to a control signal terminal; a scan signal with a potential at an effective potential is provided to a scan signal terminal; a data signal is outputted from a data signal terminal to a control node by a data writing circuit in response to the control signal and the scan signal.

As an example, in a data writing phase, a control signal at an effective potential may be provided to the control signal terminal CTR, and the first switch transistor K1 is switched on. The scan signal terminal SCAN may output a scan signal to the gate of the second switch transistor K2 through the first switch transistor K1. Also, in the data writing phase, the scan signal at the effective potential is provided to the scan signal terminal SCAN. Accordingly, the second switch transistor K2 is switched on, and the data signal terminal DATA outputs a data signal to the control node P1 through the second switch transistor K2. In this way, the control node P1 is charged, and the storage capacitor C0 may store the data signal. Optionally, in the embodiments of the present disclosure, the control signal may include a direct-current signal.

The data writing sub-circuit in the pixel circuit according to this embodiment of the present disclosure may output the data signal to the control node only in response to the control signal and the scan signal in the data writing phase. Therefore, even if the scan signals are provided in sequence to the scan signal terminals SCAN connected to each row of the pixel circuits, the potential of the control signal provided by the control signal terminal CRT may also be controlled to enable the image refreshing for the partial region.

In step 702, in a light emitting phase, a light-emitting element is driven to emit light by a driving sub-circuit in response to a potential of a control node and a potential of a power signal provided by a power signal terminal.

As an example, in the light emitting phase, the potential of the scan signal provided to the scan signal terminal SCAN jumps to an ineffective potential. Accordingly, even if the first switch transistor K1 remains switched-on under the drive of the control signal, the potential of the scan signal outputted by the scan signal terminal SCAN to the gate of the second switch transistors K2 through the first switch transistor K1 is still an ineffective potential. Therefore, the second switch transistor K2 is switched-off. Moreover, since the data signal is outputted to the control node P1 in the data writing phase, the drive transistor T1 may be switched on in the light emitting phase, and the drive transistor T1 may output a drive current to the light-emitting element Q1 according to the potential of the data signal and the potential of the power signal provided by the power signal terminal VDD, thereby driving the light-emitting element Q1 to emit light.

Figure 8:
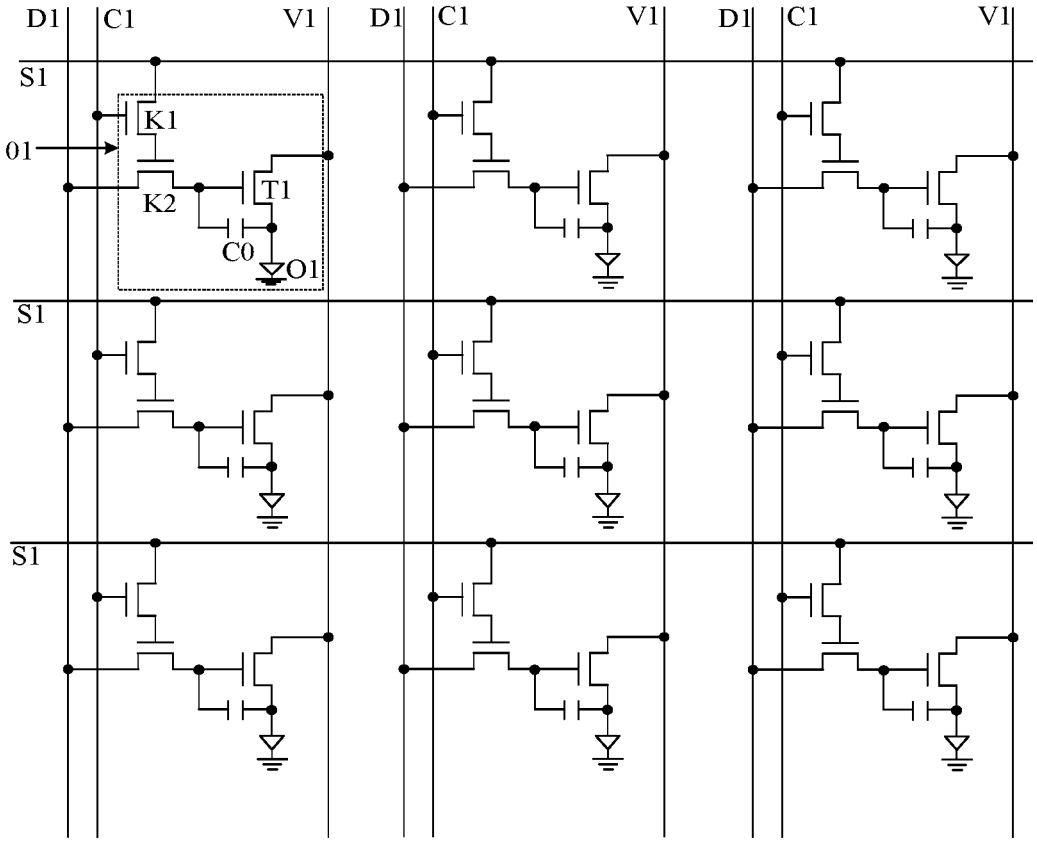
FIG. 8 illustrates a schematic structural diagram of a display substrate according to an embodiment of the present disclosure.
Figure 9:
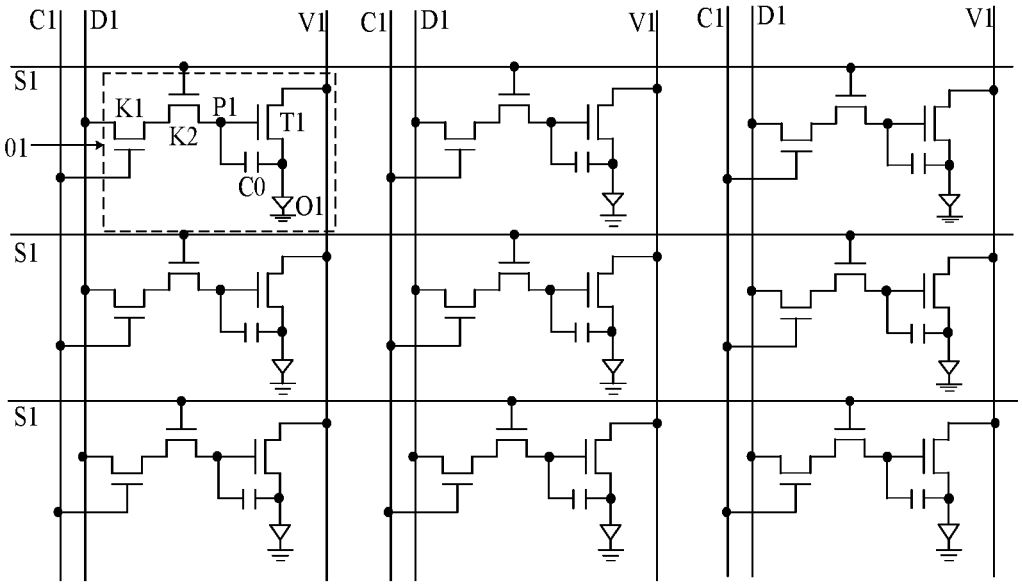
FIG. 9 illustrates a schematic structural diagram of another display substrate according to an embodiment of the present disclosure.

FIG. 8 illustrates a schematic structural diagram of a display substrate according to an embodiment of the present disclosure. FIG. 9 illustrates a schematic structural diagram of another display substrate according to an embodiment of the present disclosure. As shown in FIG. 8 and FIG. 9, the display substrate may include: a plurality of gate lines S1, a plurality of data lines D1, a plurality of control signal lines C1, a plurality of power signal lines V1, and a plurality of pixel units 01. For example, both FIG. 8 and FIG. 9 schematically show three gate lines S1, three data lines D1, three control signal lines C1, three power signal lines V1, and nine pixel units 01.

As an optional implementation, referring to FIG. 8, each pixel unit 01 may include a light-emitting element O1 and a pixel circuit as shown in any one of FIGS. 2 to 4, which is connected to the light-emitting element O1. That is, a first electrode of a first switch transistor K1 in each pixel circuit may be connected to a scan signal terminal SCAN, and a second electrode of the first switch transistor K1 may be connected to a gate of the second switch transistor K2; and a first electrode of the second switch transistor K2 may be connected to a data signal terminal DATA.

As another optional implementation, referring to FIG. 9, each pixel unit 01 may include a light-emitting element O1, and a pixel circuit as shown in any one of FIGS. 2, 5, and 6, which is connected to the light-emitting element O1. That is, a first electrode of a first switch transistor K1 in each pixel circuit may be connected to a data signal terminal DATA, and a second electrode of the first switch transistor K1 may be connected to a first electrode of a second switch transistor K2; and a gate of the second switch transistor K2 may be connected to a scan signal terminal SCAN.

Referring to FIG. 8 and FIG. 9, each gate line S1 may be connected to the scan signal terminals SCAN of a row of pixel circuits. Each data line D1 may be connected to the data signal terminals DATA of a column of pixel circuits. Each control signal line C1 may be connected to the control signal terminals CTR of a column of pixel circuits. Each power signal line V1 is connected to the power signal terminals VDD of a column of pixel circuits.

Each gate line S1 may provide the scan signals to the scan signal terminals SCAN connected thereto, in sequence. Each data line D1 may provide the data signals to the data signal terminals DATA connected thereto. Each control signal line C1 may provide the control signals to the control signal terminals CTR connected thereto. Each power signal line V1 may provide the power signals to the power signal terminals VDD connected thereto.

Optionally, in the embodiments of the present disclosure, the control signal lines C1 and the data lines D1, which are included in the display substrate, may be the same in number, and may be disposed in parallel.

For example, each of the display substrates shown in FIGS. 8 and 9 includes three control signal lines C1 and three data lines D1 in total. Moreover, one control signal line C1 and one data line D1, which are connected to the pixel circuits in the same column of pixel units 01, may be disposed in parallel at the same side of the column of pixel units 01. For example, referring to FIG. 8 and FIG. 9, it can be seen that one control signal line C1 and one data line D1, which are connected to the pixel circuits in the first column of pixel units 01, may be both located at the left side of the first column of pixel units 01.

By disposing the control signal lines C1 and the data lines D1 in parallel and with the same number, a routing process may be simplified, so that each pixel circuit in the display substrate may drive the light-emitting elements to emit light, under the control of the control signals and the scan signals.

In summary, the embodiments of the present disclosure provide a display substrate. The display substrate includes control signal lines connected to control signal terminals of pixel circuits; and the pixel circuits in the display substrate may drive the light-emitting element to emit light only in response to the control signal provided by the control signal terminal and the scan signal provided by the scan signal terminal. Therefore, the image refreshing of a partial region may be enabled as long as the control signal lines and the scan signal lines connected to the pixel circuits located in a region to be refreshed are controlled to provide signals at an effective potential. The display substrate according to the embodiments of the present disclosure is high in drive flexibility, and thus effectively improves the flexibility in image refreshing.

Figure 10:
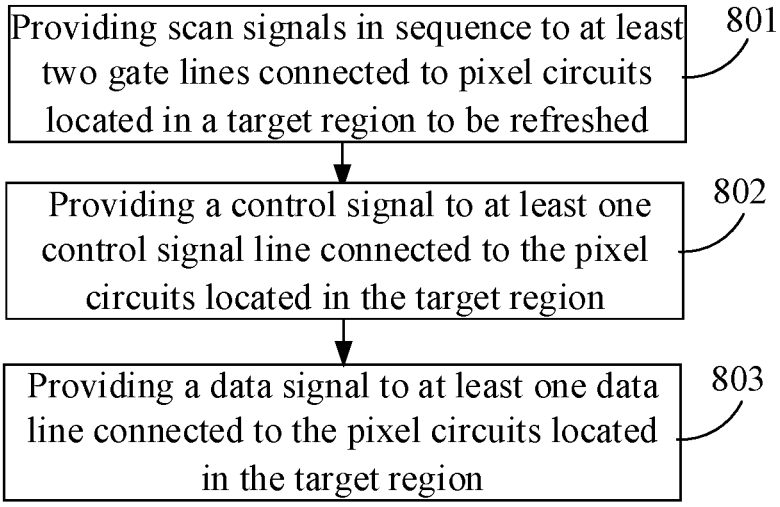
FIG. 10 illustrates a flowchart of a method for driving a display substrate according to an embodiment of the present disclosure.

FIG. 10 is a flowchart of a method for driving a display substrate according to an embodiment of the present disclosure. The method may be used to drive the display substrates as shown in FIG. 8 or FIG. 9, and may be applied to drive devices of the display substrates. The drive device may include a gate drive circuit and a source drive circuit. As shown in FIG. 10, the method may include the following steps.

In step 801, scan signals are provided in sequence to at least two gate lines connected to pixel circuits located in a target region to be refreshed.

Optionally, the pixel circuits located in the target region and the pixel circuits located in other regions than the target region may be connected to different gate drive circuits. Accordingly, the gate drive circuits connected to the pixel circuits in the target region may provide the scan signals to at least two gate lines connected thereto. Moreover, the gate drive circuits connected to the pixel circuits in other regions may not provide the scan signals to the gate lines connected thereto.

In step 802, a control signal is provided to at least one control signal line connected to the pixel circuits located in the target region.

Optionally, the pixel circuits located in the target region and the pixel circuits located in other regions are connected to the same source drive circuit. Accordingly, the source drive circuit may only provide the control signals to at least one control signal line connected to the pixel circuits located in the target region, instead of providing the control signals to the control signal lines connected to the pixel circuits in other regions than the target region.

Alternatively, the pixel circuits located in the target region and the pixel circuits located in other regions than the target region may be connected to different source drive circuits. Accordingly, the source drive circuits connected to the pixel circuits in the target region may provide a control signal to at least one control signal line connected thereto. Moreover, the source drive circuits connected to the pixel circuits in other regions may not provide the control signal to the control signal line connected thereto.

In step 803, a data signal is provided to at least one data line connected to the pixel circuits located in the target region.

Optionally, the pixel circuits located in the target region to be refreshed and the pixel circuits located in other regions may be connected to the same source drive circuit. Accordingly, the source drive circuit may provide the data signal to at least one data line connected to the pixel circuits located in the target region, instead of providing the data signal to the data signal lines connected to the pixel circuits in other regions.

Alternatively, the pixel circuits located in the target region to be refreshed and the pixel circuits located in other regions than the target region may be connected to different source drive circuits. Accordingly, the source drive circuit connected to the pixel circuit in the target region may provide the data signal to at least one data line connected thereto. Moreover, the source drive circuits connected to the pixel circuits in other regions may not provide the data signal to the data signal line connected thereto.

It should be noted that the order of the method (i.e. steps 801 to 803) for driving the display substrate is not defined in the embodiments of the present disclosure. For example, the above-mentioned steps 801 to 803 may be executed simultaneously. That is, when the scan signals are provided in sequence to at least two gate lines connected to the pixel circuits located in the target region, the control signals may be provided to at least one control signal line connected to the pixel circuits located in the target region, and the data signals may be provided to at least one data line connected to the pixel circuits located in the target region.

In summary, the embodiments of the present disclosure provide a method for driving a display substrate. The pixel circuits in the display substrate may drive the light-emitting element to emit light only in response to the control signal provided by the control signal terminal and the scan signal provided by the scan signal terminal. Therefore, the signals may be provided only to the gate lines, the control signal lines and the data lines connected to the pixel circuit located in a target region of an image to be refreshed, to control the pixel circuits only in the region of the image to be refreshed to drive the light-emitting elements connected thereto to emit light, thereby enabling the image refreshing of the partial region of the display substrate and reducing the drive power consumption. The display substrate according to the embodiments of the present disclosure is high in drive flexibility, and thus effectively improves the flexibility in image refreshing.

FIG. 11 illustrates a schematic structural diagram of a display device according to an embodiment of the present disclosure. As shown in FIG. 11, the display device may include: a display substrate 100 as shown in FIG. 8 or FIG. 9 and a drive device for the display substrate 100. The drive device may include source drive circuits 200 and gate drive circuits 300.

The gate drive circuits 300 may be connected to a plurality of gate lines S1 in the display substrate 100. The gate drive circuits 300 may provide scan signals to the plurality of gate lines S1 connected thereto.

The source drive circuits 200 may be connected to a plurality of data lines D1 and a plurality of control signal lines C1 in the display substrate 100, respectively. The source drive circuits 200 may provide data signals to the plurality of data lines D1 connected thereto, and provide control signals to a plurality of control signal lines C1 connected thereto.

Optionally, the display device may include a plurality of gate drive circuits 300, each of which may be connected to a switching-on signal terminal STV and a plurality of gate lines S1, respectively. Each of the gate drive circuits 300 may provide scan signals in sequence to the plurality of gate lines S1 connected thereto in response to a switching-on signal provided by the switching-on signal terminal STV connected thereto.

The respective gate drive circuits 300 are connected to different switching-on signal terminals STV, and different gate lines. That is, the respective switching-on signal terminals STV included in the display device may be separated in wiring. Accordingly, the display substrate 100 may be divided into a plurality of partitions in an extension direction of the data lines D1. Each partition includes a plurality of adjacent rows of pixel units, and the number of the partitions may be the same as the number of the gate drive circuits. The plurality of gate lines S1 connected to each gate drive circuit 300 may be connected to a plurality of rows of pixel units in one partition, and the pixel units in each partition may be separately controlled by the gate drive circuits 300 connected thereto, thereby refreshing the image of the partial region.

As an example, referring to FIG. 11, the display device shown therein includes a total of four gate drive circuits 300. Accordingly, the display substrate 100 may be divided into four partitions, namely, a partition 1001, a partition 1002, a partition 1003, and a partition 1004, which are arranged along the extension direction X of the data lines. Also, referring to FIG. 11, it can be seen that a first gate drive circuit 300 (1) may be connected to a switching-on signal terminal STV(1) and each row of pixel units in the partition 1001, respectively; a second gate drive circuit 300 (2) may be connected to a switching-on signal terminal STV (2) and each row of pixel units in the partition 1002; a third gate drive circuit 300 (3) may be connected to a switching-on signal terminal STV (3) and each row of pixel units in the partition 1003; and a fourth gate drive circuit 300 (4) may be connected to a switching-on signal terminal STV (4) and each row of pixel units in the partition 1004, respectively. Each gate drive circuit 300 may provide scan signals in sequence to the plurality of gate lines connected thereto, when the switching-on signals provided by the switching-on signal terminal STV connected thereto have an effect potential.

Optionally, FIG. 12 illustrates a schematic structural diagram of a display device in the related art. Referring to FIG. 12, the display device shown therein further includes four gate drive circuits G1 to G4, and each gate drive circuit is connected to a plurality of gate lines S1 in different regions. For example, in conjunction with FIG. 12 and FIG. 13, when every frame is displayed, a first gate drive circuit G1 provides scan signals in sequence to a plurality of gate lines in a region 1; a second gate drive circuit G2 provides scan signals in sequence to a plurality of gate lines in a region 2; a third gate drive circuit G3 provides scan signals in sequence to a plurality of gate lines in a region 3; and a fourth gate drive circuit G4 provides scan signals in sequence to a plurality of gates lines in a region 4. Moreover, each frame scanning includes a charging phase and a display phase, and the display phase of each frame scanning may cycle in sequence from the end of the charging phase of the current frame scanning to the beginning of a charging phase of a next frame of display.

Although each of the display devices shown in FIG. 11 and FIG. 12 includes a plurality of gate drive circuits, a display device provided in the related art (i.e., FIG. 12) includes four gate drive circuits connected to the same switching-on signal terminal. Therefore, if a potential of a switching-on signal provided by the switching-on signal terminals is an effective potential, the four gate drive circuits will still scan regions 1 to 4 in sequence. That is, it is still impossible to scan each region separately. Since the display device (i.e., FIG. 11) according to the embodiments of the present disclosure includes four gate drive circuits connected to different switching-on signal terminals, a potential of a switching-on signal provided by each switching-on signal terminal may be controlled to implement separate control over each gate drive circuit. As a result, the gate lines in the four partitions can be further scanned separately. That is, the image refreshing of the partial region may be enabled by disposing a plurality of gate drive circuits, and connecting the respective gate drive circuits to different switching-on signal terminals.

It should be noted that the number of the gate drive circuits 300 included in the display device according to the embodiments of the present disclosure may be arbitrarily set according to actual needs, and the number of the gate drive circuits 300 may be related to the area of the display substrate. For example, the display device may include six gate drive circuits 300. Accordingly, the display substrate may be divided into six partitions arranged along the extension direction X of the data lines, and the image in each partition may be separately refreshed. By disposing a larger number of gate drive circuits and connecting the respective gate drive circuits to different switching-on signal terminals, a region of a smaller area can be further controlled separately. Therefore, the control accuracy in image refreshing of a partial region can be improved.

FIG. 14 illustrates a schematic structural diagram of a source drive circuit according to an embodiment of the present disclosure. As shown in FIG. 14, the source drive circuit 200 may include: a plurality of signal generation sub-circuits 2001.

Each signal generation sub-circuit 2001 may be connected to a clock signal terminal DIO, at least one control signal line C1 and at least one data line D1, respectively. Each signal generation sub-circuit 2001 may output a control signal to the control signal line C1 connected thereto and output a data signal to the data line D1 connected thereto, according to a clock signal provided by the clock signal terminal DIO connected thereto. Also, the clock signal terminals DIO connected to the respective signal generation sub-circuits 2001 may be different. The respective signal generation sub-circuits 2001 may be connected to different control signal lines C1, and also different data lines D1.

For example, the source drive circuit 200 shown in FIG. 14 includes a total of three signal generation sub-circuits 2001. A first signal generation sub-circuit 2001 (1) is connected to a clock signal terminal DIO (1), a second signal generating sub-circuit 2001 (2) is connected to a clock signal terminal DIO (2), and a third signal generation sub-circuit 2001 (3) is connected to a clock signal terminal DIO (3). Each signal generation sub-circuit 2001 may output a control signal to the control signal line C1 connected thereto and output a data signal to the data line D1 connected thereto, when a clock signal is provided by the clock signal terminal DIO connected thereto.

Each signal generation sub-circuit 2001 provides a control signal to at least one control signal line C1 connected thereto, according to the clock signal provided by the clock signal terminal DIO connected thereto. Therefore, by disposing the source drive circuit 200 including a plurality of signal generation sub-circuits 2001, and connecting different clock signal terminals DIO to the respective signal generation sub-circuits 2001, the clock signals provided by the respective clock signal terminals DIO may be controlled to control the control signals provided by the control signal lines C1 in different regions of the display substrate 100 thereby controlling different regions separately.

Optionally, each signal generation sub-circuit 2001 may be connected to the clock signal terminal DIO, a plurality of adjacent control signal lines C1 in the display substrate 100, and a plurality of adjacent data lines D1 in the in the display substrate 100. By connecting each signal generation sub-circuit 2001 with an adjacent data line D1 and an adjacent control signal line C1, the image of the partial region can be refreshed while the routing process can be simplified.

Figure 15:
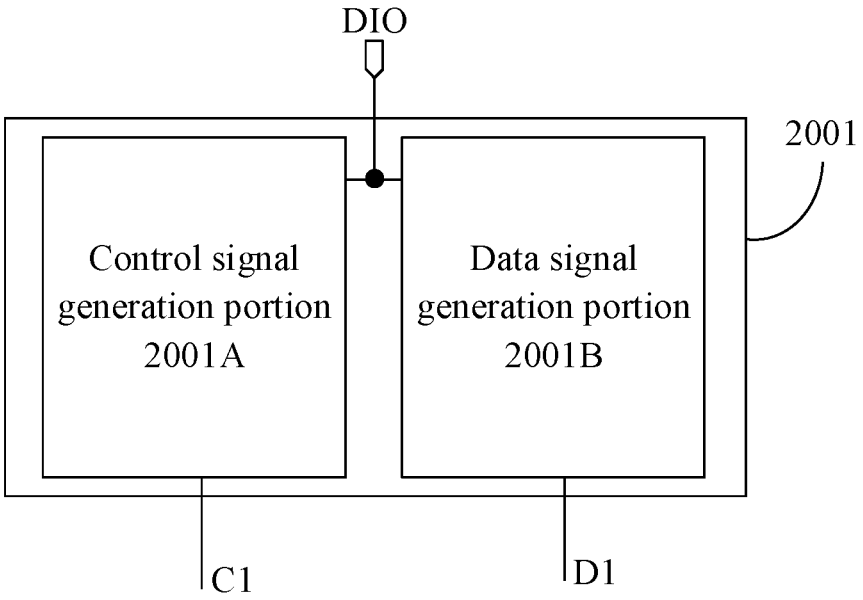
FIG. 15 illustrates a schematic structural diagram of another source drive circuit according to an embodiment of the present disclosure.

FIG. 15 illustrates a schematic structural diagram of a signal generation sub-circuit 2001 according to an embodiment of the present disclosure. As shown in FIG. 15, each signal generation sub-circuit 2001 may include: a control signal generation portion 2001A and a data signal generation portion 2001B.

The control signal generation portion 2001A may be connected to the clock signal terminal DIO and at least one control signal line C1, respectively (FIG. 15 schematically shows one control signal line C1). The control signal generation portion 2001A may output a control signal to at least one control signal line C1 connected thereto, according to the clock signal provided by the clock signal terminal DIO connected thereto.

The data signal generation portion 2001B may be connected to the clock signal terminal DIO and at least one data line D1, respectively (FIG. 15 schematically shows one data line D1). The data signal generation portion 2001B may output a data signal to at least one data line D1 connected thereto, according to the clock signal provided by the clock signal terminal DIO connected thereto.

Figure 16:
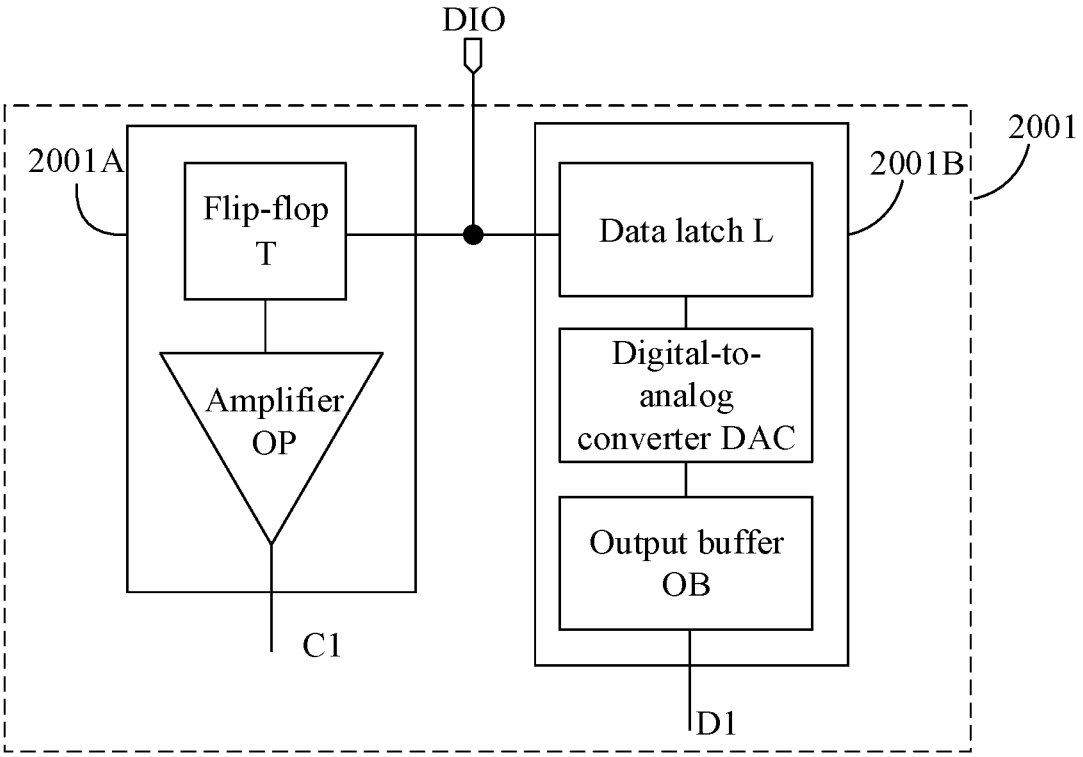
FIG. 16 illustrates a schematic structural diagram of yet another source drive circuit according to an embodiment of the present disclosure.

FIG. 16 illustrates a schematic structural diagram of another signal generation sub-circuit 2001 according to an embodiment of the present disclosure. As shown in FIG. 16, the control signal generation portion 2001A may include: a flip-flop T and an amplifier OP.

Referring to FIG. 16, the flip-flop T may be connected to the clock signal terminal DIO and an input terminal of the amplifier OP, respectively, and an output terminal of the amplifier OP may be connected to at least one control signal line C1 (FIG. 16 also schematically shows one control signal line C1).

Optionally, referring to FIG. 16, the data signal generation portion 2001B may include a data latch L, a digital-to-analog converter DAC, and a buffer OB.

Referring to FIG. 16, the data latch L may be connected to the clock signal terminal DIO and the digital-to-analog converter DAC, respectively; the digital-to-analog converter DAC may be connected to a buffer OB; and the buffer OB may be connected to at least one data line D1 (FIG. 16 also schematically shows one data line D1).

Optionally, in the embodiments of the present disclosure, the display device may also include a plurality of source drive circuits 200, each of which may include a plurality of signal generation sub-circuits 2001. Accordingly, the display substrate 100 may be divided into a plurality of partitions arranged along the extension direction Y of the gate lines, and the number of the partitions may be the same as the number of the signal generation sub-circuits 2001 included in the display device.

For example, referring to FIG. 11, the display device shown therein includes a total of two source drive circuits 200, each of which includes three signal generation sub-circuits 2001. Different signal generation sub-circuits 2001 are connected to different clock signal terminals DIO. That is, referring to FIG. 11, six clock signal terminals DIO are included in total. Accordingly, the display substrate 100 may be divided into six partitions arranged along the extension direction Y of the gate line. By controlling the clock signal provided by each clock signal terminal DIO, the control signal lines C1 in different partitions may be controlled separately, thereby refreshing the image of the partial region.

It should be noted that the display device may also include a larger number of source drive circuits 200, each of which may include a larger number of signal generation sub-circuits 2001. Accordingly, the display substrate 100 may be divided into more partitions along the extension direction Y of the gate lines, thereby controlling smaller regions separately with higher control accuracy.

As an example, in conjunction with FIG. 8 and FIG. 11, assuming that a target region to be refreshed is determined to be a region A in the display substrate 100, it can be further determined that a gate drive circuit 300 (2) is connected to the pixel circuits located in the region A, and a clock signal terminal DIO2 is connected to the signal generation sub-circuit 2001 which is connected to the control signal line and the data line in the region A. Accordingly, only a switching-on signal terminal STV(3) connected to the gate drive circuit 300 (3) may be controlled to output a switching-on signal at an effective potential, so that the gate drive circuit 300 (3) provides the scan signals in sequence to at least two gate lines in this region A under the control of the switching-on signal. Moreover, only the clock signal terminal DIO (2) may be controlled to provide a clock signal. Accordingly, the signal generation sub-circuit 2001 connected to the clock signal terminal DIO (2) may provide signals to the control signal line C1 and the data line D1 in the region A according to this clock signal. Here, a first switch transistor K1 located in the pixel circuit located in the region A may be then switched on under the control of the control signal, and output a scan signal at an effective potential to a second switch transistor K2 connected thereto; and the second switch transistor K2 may output a data signal to the control node P1 under the control of the scan signal, thereby allowing the light-emitting element O1 located in the region A to emit light. Therefore, the image in the region A is then refreshed separately.

In summary, the embodiments of the present disclosure provide a display device. The pixel circuits in the display device may drive the light-emitting element to emit light only in response to the control signal provided by the control signal terminal and the scan signal provided by the scan signal terminal. Also, the source drive circuit included in the display device may be connected to the control signal line and the data line, and provide a control signal to the control signal line and a data signal to the data line. Therefore, the source drive circuit may provide the signals only to the control signal line and the data line, which are connected to the pixel circuits located in a region of an image to be refreshed, to control the pixel circuits in the region of the image to be refreshed to drive the light-emitting elements connected thereto to emit light. As a result, the image in the partial region can be refreshed. The display substrate according to the embodiments of the present disclosure is high in drive flexibility, and thus effectively improves the flexibility in image refreshing.

An embodiment of the present disclosure provides a method for driving a display device. The method may be used to drive the display device as shown in FIG. 11, and may be applied to a drive device of the display device. The drive device may include a timing controller. The method may include:

providing a clock signal to a clock signal terminal connected to a target signal generation sub-circuit.

The control signal line and the data line, which are connected to the target signal generation sub-circuit, are both connected to a pixel circuit located in a target region to be refreshed.

Optionally, the drive device may also be connected to a control system of the display device, and the control system may pre-store position information of a target region to be refreshed and image data of the target region. The control system may determine the control signal lines and the data lines connected to the pixel circuits in the target region, and then may determine a target signal generation sub-circuit connected to the control signal line and the data line.

Accordingly, if only the image of the target region needs to be updated, the control system may control the timing controller to provide a clock signal only to a clock signal terminal connected to the target signal generation sub-circuit, instead of providing the clock signal to the clock signal terminal connected to other signal generation sub-circuits than the target signal generation sub-circuit. Therefore, the signals are provided only to the control signal line and the data line, which are connected to the pixel circuits in the target region, rather than the control signal line and the data line, which are connected to the pixel circuits in other regions than the target region. That is, the image of the partial region is refreshed.

It should be noted that the control system may also be connected to the drive device of the display substrate. That is, the control system may be connected to the gate drive circuit and the source drive circuit. Accordingly, after determining the target region, the control system may control the gate drive circuit connected to the pixel circuit in the target region to provide scan signals in sequence to at least two gate lines connected to the pixel circuits in the target region, control the source drive circuit to provide a control signal to at least one control signal line connected to the pixel circuits located in the target region, and control the source drive circuit to provide a signal to at least one data line connected to the pixel circuits located in the target region.

Taking the pixel circuit shown in FIG. 4 and the target region determined as the region A of the display substrate shown in FIG. 11 as an example, a principle for driving the display device is introduced with the N-type transistors as the respective transistors, by way of example.

Figure 17:
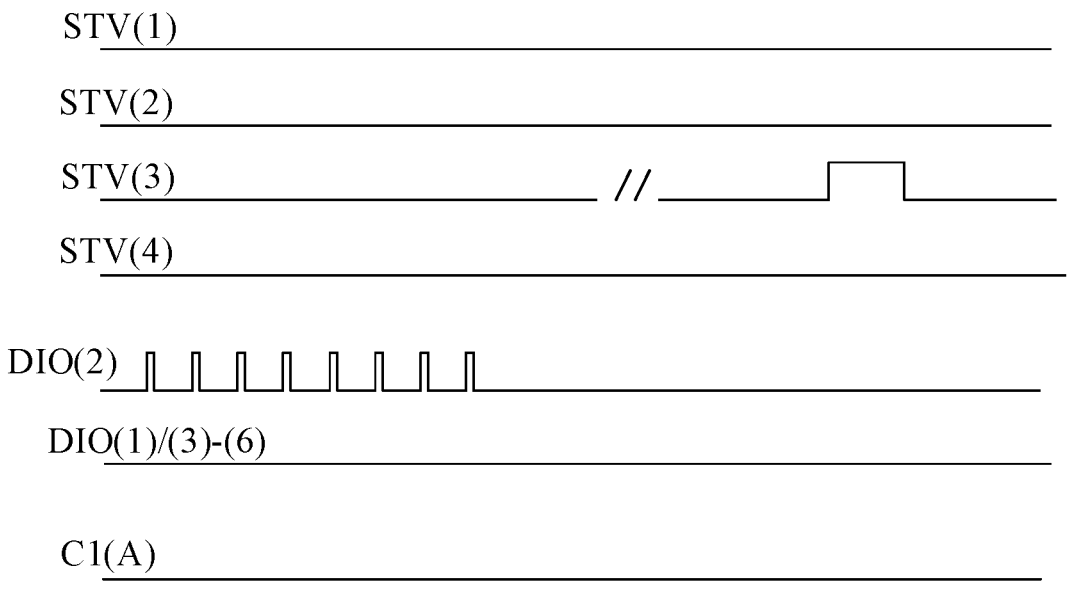
FIG. 17 illustrates a timing diagram of respective signal terminals in a display device according to an embodiment of the present disclosure.

FIG. 17 illustrates a timing diagram of respective signal terminals in a display device according to an embodiment of the present disclosure. Referring to FIG. 11, it can be seen that the gate drive circuit connected to the pixel circuits in a target region A is a gate drive circuit 300 (3), and a switching-on signal terminal connected to the gate drive circuit 300 (3) is STV (3). Therefore, referring to FIG. 17, only the switching-on signal terminal STV (3) may be controlled to provide a switching-on signal at an effective potential, while the switching-on signal terminals STV (1), STV (2) and STV (4) are controlled not to provide the switching-on signal. Accordingly, the gate drive circuit 300 (3) may provide scan signals to at least two gate lines connected to the pixel circuits in the region A under the drive of the switching-on signal provided by the switching-on signal terminal STV (3).

Moreover, referring to FIG. 11, it can be further seen that since a clock signal terminal connected to the target signal generation sub-circuit 2001 is DIO (2), the control signal line and the data line, which are connected to the target signal generation sub-circuit 2001, are connected to the pixel circuits of the target region A. Therefore, referring to FIG. 17, only the clock signal terminal DIO (2) may be controlled to provide a clock signal, while the clock signal terminals DIO (1), DIO (3) to DIO (6) are controlled not to provide the clock signal. Accordingly, the signal generation sub-circuit 2001 connected to the clock signal terminal DIO (2) may provide a control signal at an effective potential to the control signal line C1 (A) connected to the pixel circuits in the target region A, and provide a data signal to the data line D1 connected to the pixel circuits located in the region A, according to the clock signal.

Furthermore, each first switch transistor K1 in the pixel circuits located in the target region A may be switched on under the control of the control signal, and may output a scan signal to the second switch transistor K2 connected thereto, and each second switch transistor K2 in the pixel circuits located in the target region A is switched on. Each second switch transistor K2 may output the data signal provided by the data line D1 to the control node P1 connected thereto. Each drive transistor T1 in the pixel circuits located in the target region A may drive the light-emitting element O1 connected thereto to emit light, thereby refreshing the target region A separately.

Taking the pixel circuit shown in FIG. 4 and the target regions determined as the regions A and B of the display substrate shown in FIG. 11 as an example, a principle for driving the display device is introduced with the N-type transistors as the respective transistors, by way of example.

Figure 18:
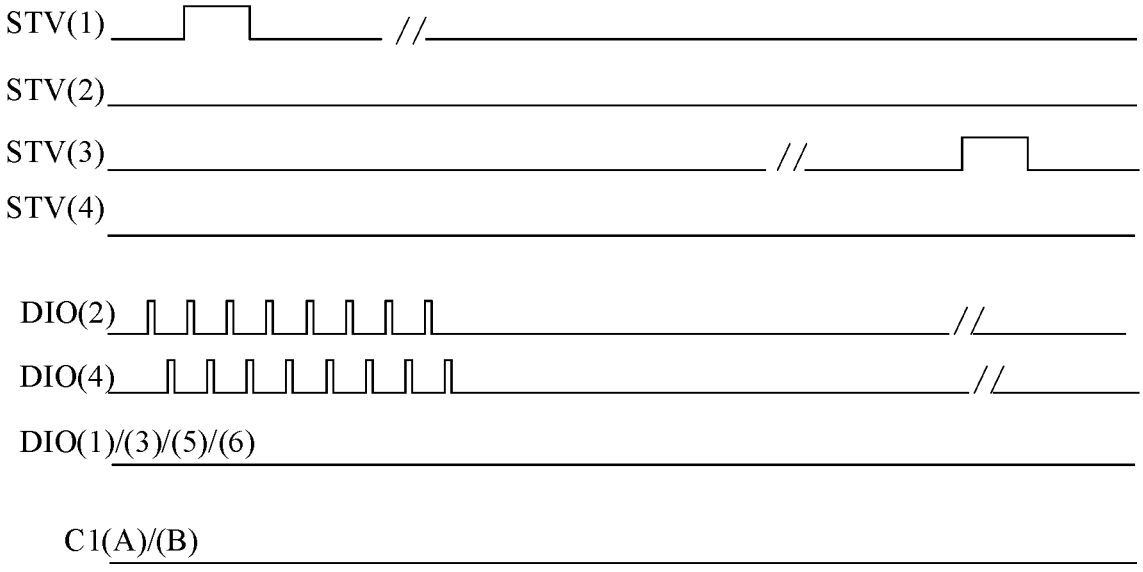
FIG. 18 illustrates a timing diagram of respective signal terminals in another display device according to an embodiment of the present disclosure.

FIG. 18 illustrates a timing diagram of respective signal terminals in a display device according to an embodiment of the present disclosure. Referring to FIG. 11, it can be seen that the gate drive circuits connected to the pixel circuits in a target region A include a gate drive circuit 300 (3), and a switching-on signal terminal connected to the gate drive circuit 300 (3) is STV (3). The gate drive circuits connected to the pixel circuits in a target region A include a gate drive circuit 300 (1), and a switching-on signal terminal connected to the gate drive circuit 300 (1) is STV (1). Therefore, referring to FIG. 18, only the switching-on signal terminals STV (1) and STV (3) may be controlled to provide switching-on signals at an effective potential, while the switching-on signal terminals STV (2) and STV (4) are controlled not to provide the switching-on signal. Accordingly, the gate drive circuit 300 (1) may provide scan signals in sequence to the gate lines connected to the pixel circuits in the target region B under the control of the switching-on signal provided by the switching-on signal terminal STV (1). Similarly, the gate drive circuit 300 (3) may provide the scan signals in sequence to the gate lines connected to the pixel circuits in the target region A under the control of the switching-on signal provided by the switching-on signal terminal STV (3).

Moreover, referring to FIG. 11, it can be seen that since clock signal terminals connected to the target signal generation sub-circuit 2001 include DIO (2) and DIO (4), the control signal line and the data line, which are connected to the target signal generation sub-circuit 2001, are connected to the pixel circuits in the target regions A and B. Therefore, referring to FIG. 18, the clock signal terminals DIO (2) and DIO (4) may be controlled to provide clock signals, while the clock signal terminals DIO (1), DIO (3), DIO (5) and DIO (6) are controlled not to provide the clock signal.

Accordingly, the signal generation sub-circuit 2001 connected to the clock signal terminal DIO (2) may provide a control signal at an effective potential to the control signal line C1 (A) connected to the pixel circuits in the target region A, and provide a data signal to the data line D1 connected to the pixel circuits located in the target region A, according to the clock signal. The signal generation sub-circuit 2001 connected to the clock signal terminal DIO (4) may provide a control signal at an effective potential to the control signal line C1 (B) connected to the pixel circuits in the target region B, and provide a data signal to the data line D1 connected to the pixel circuits located in the target region B, according to the clock signal.

Furthermore, the first switch transistors K1 in the pixel circuits located in the target regions A and B may be switched on under the control of the control signal; each first switch transistor K1 may output the scan signal to the second switch transistor K2 connected thereto; and the second switch transistors K2 in the pixel circuits located in the target regions A and B are switched on. Each second switch transistor K2 in the pixel circuits located in the target regions A and B may output a data signal provided by the data line D1 to the control node P1 connected thereto. Each drive transistor T1 in the pixel circuits located in the target region A drives the light-emitting element O1 located in the target region A to emit light, thereby refreshing the target region A separately. Similarly, each drive transistor T1 in the pixel circuits located in the target region A drives the light-emitting element O1 located in the target region B to emit light, thereby refreshing the target region B separately.

Taking the pixel circuit shown in FIG. 4 and the N-type transistors being the respective transistors as an example, a principle for driving the display device is introduced by refreshing the display device shown in FIG. 11 in a full screen, by way of example.

Figure 19:
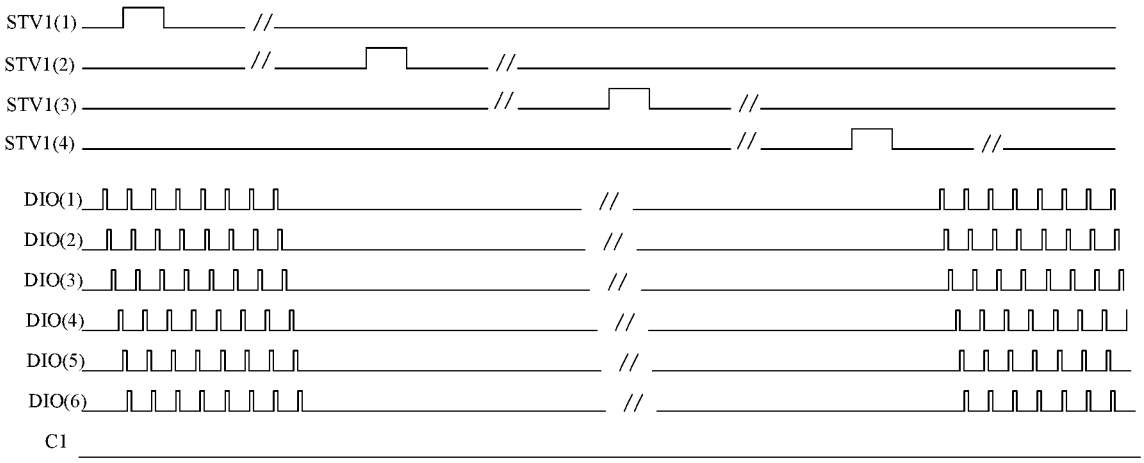
FIG. 19 illustrates a timing diagram of respective signal terminals in yet another display device according to an embodiment of the present disclosure.

FIG. 19 illustrates a timing diagram of respective signal terminals in a display device according to an embodiment of the present disclosure. Since full-screen refreshing is required, it can be seen, by referring to FIG. 19, that the switching-on signal terminals STV (1) to STV (4) may be controlled to provide switching-on signals at effective potentials in sequence. Accordingly, the gate drive circuits 300 (1) and 300 (4) may provide scan signals in sequence to all the gate lines in the display substrate.

Moreover, referring to FIG. 19, it can be seen that the clock signal terminals DIO (1) to DIO (6) may be controlled to provide clock signals in sequence. Accordingly, the respective signal generation sub-circuits 2001 may provide signals to all the control signal lines C1 and data lines D1 in the display substrate according to the clock signals provided by the clock signal terminals DIOs connected thereto. Furthermore, all the pixel circuits in the display substrate may sequentially drive the light-emitting elements O1 connected thereto to emit light, thereby refreshing all the regions in the display device.

It should be noted that, in order not to affect the normal display of other regions than the target region to be refreshed, the full-screen refreshing may be interspersed when partition refreshing is performed, thereby reducing the full-screen refreshing frequency and reducing the power consumption. Of course, it is also possible to increase the dynamic response speed and improve the display quality by increasing the refreshing frequency of the partial region while the full-screen refreshing frequency remains unchanged.

In summary, the embodiments of the present disclosure provide a method for driving a display device. The pixel circuits in the display device may drive the light-emitting element to emit light only in response to the control signal provided by the control signal terminal and the scan signal provided by the scan signal terminal. Also, since the control signals are generated according to the clock signals, the clock signals may be provided only to the clock signal terminals connected to the target signal generation sub-circuits, so that the control signals may be provided only to the control signal terminals connected to the pixel circuits in the target region to be refreshed. That is, only the pixel circuits in the target region to be refreshed may be controlled to refresh the image for the partial region. The display device according to the embodiments of the present disclosure is high in drive flexibility, and thus effectively improves the flexibility in image refreshing. Moreover, since the display device according to the embodiments of the present disclosure may enable image refreshing for a partial region, it can be applied to scenes such as electronic stop boards and advertising stop boards, where only the image of a partial region needs to be updated.

Optionally, the display device may include: an OLED display panel, a piece of electronic paper, a mobile phone, a tablet computer, a television, a displayer, a notebook computer, a digital photo frame, or any products or components that have a display function.

Those skilled in the art may clearly understand that, for the convenience and conciseness of the description, the specific operating processes of the pixel circuit, the display substrate and the display device as described above can be found by referring to corresponding processes in the foregoing method embodiments, the details of which will not be repeated here.

Described above are merely optional embodiments of the present disclosure, which are not intended to limit the present disclosure. Any modifications, equivalent substitutions, improvements and the like made within the spirit and principle of the present disclosure shall fall within the protection scope of the present disclosure.

What is claimed is:

1. A pixel circuit, comprising: a data writing sub-circuit and a driving sub-circuit, wherein the data writing sub-circuit is connected to a control signal terminal, a scan signal terminal, a data signal terminal and a control node, respectively, and is used to output a data signal from the data signal terminal to the control node in response to a control signal provided by the control signal terminal and a scan signal provided by the scan signal terminal; and the driving sub-circuit is connected to the control node, a power signal terminal and a light-emitting element, respectively, and is used to drive the light-emitting element to emit light in response to a potential of the control node and a power signal provided by the power signal terminal.

2. The pixel circuit according to claim 1, wherein the data writing sub-circuit comprises a switch portion and a data writing portion;

the switch portion is connected to the control signal terminal, the scan signal terminal, and the data writing portion, respectively, and is used to output the scan signal to the data writing portion in response to the control signal; and the data writing portion is further connected to the data signal terminal and the control node, respectively, and is used to output the data signal to the control node in response to the scan signal.

3. The pixel circuit according to claim 2, wherein the switch portion comprises a first switch transistor, wherein a gate of the first switch transistor is connected to the control signal terminal, a first electrode of the first switch transistor is connected to the scan signal terminal, and a second electrode of the first switch transistor is connected to the data writing portion.

4. The pixel circuit according to claim 2, wherein the data writing portion comprises a second switch transistor;

a gate of the second switch transistor is connected to the switch portion, a first electrode of the second switch transistor is connected to the data signal terminal, and a second electrode of the second switch transistor is connected to the control node.

5. The pixel circuit according to claim 1, wherein the data writing sub-circuit comprises a switch portion and a data writing portion;

the switch portion is connected to the control signal terminal, the data signal terminal and the data writing portion, respectively, and is used to output the data signal to the data writing portion in response to the control signal; and the data writing portion is further connected to the scan signal terminal and the control node, respectively, and is used to output the data signal to the control node in response to the scan signal.

6. The pixel circuit according to claim 5, wherein the switch portion comprises a first switch transistor;

a gate of the first switch transistor is connected to the control signal terminal, a first electrode of the first switch transistor is connected to the data signal terminal, and a second electrode of the first switch transistor is connected to the data writing portion.

7. The pixel circuit according to claim 5, wherein the data writing portion comprises a second switch transistor;

a gate of the second switch transistor is connected to the scan signal terminal, a first electrode of the second switch transistor is connected to the switch portion, and a second electrode of the second switch transistor is connected to the control node.

8. The pixel circuit according to claim 1, wherein the driving sub-circuit comprises a drive transistor and a storage capacitor;

a gate of the drive transistor is connected to the control node, a first electrode of the drive transistor is connected to the power signal terminal, and a second electrode of the drive transistor is connected to the light emitting element; and one terminal of the storage capacitor is connected to the control node, and the other terminal of the storage capacitor is connected to the second electrode of the drive transistor.

9. A display substrate, comprising: a plurality of gate lines, a plurality of data lines, a plurality of control signal lines, a plurality of power signal lines and a plurality of pixel units, wherein each of the pixel units comprises: a light-emitting element and a pixel circuit connected to the light-emitting element;

the pixel circuit comprises: a data writing sub-circuit and a driving sub-circuit, the data writing sub-circuit is connected to a control signal terminal, a scan signal terminal, a data signal terminal and a control node, respectively, and is used to output a data signal from the data signal terminal to the control node in response to a control signal provided by the control signal terminal and a scan signal provided by the scan signal terminal;

the driving sub-circuit is connected to the control node, a power signal terminal and a light-emitting element, respectively, and is used to drive the light-emitting element to emit light in response to a potential of the control node and a power signal provided by the power signal terminal; and each of the gate lines is connected to scan signal terminals of a row of the pixel circuits, each of the data lines is connected to data signal terminals of a column of the pixel circuits, each of the control signal lines is connected to control signal terminals of a column of the pixel circuits, and each of the power signal lines is connected to power signal terminals of a column of the pixel circuit.

10. The display substrate according to claim 9, wherein the display substrate comprises the control signal lines having a number the same as the number of the data lines, and the control signal lines are disposed in parallel with the data lines.

11. The display substrate according to claim 9, wherein one control signal line and one data line which are connected to each column of the pixel circuits are located at the same side of the column of pixel circuits.

12. A display device, comprising: a display substrate, a source drive circuit and a gate drive circuit, wherein the display substrate comprises: a plurality of gate lines, a plurality of data lines, a plurality of control signal lines, a plurality of power signal lines and a plurality of pixel units, each of the pixel units comprises: a light-emitting element and a pixel circuit connected to the light-emitting element;

the pixel circuit comprises: a data writing sub-circuit and a driving sub-circuit, the data writing sub-circuit is connected to a control signal terminal, a scan signal terminal, a data signal terminal and a control node, respectively, and is used to output a data signal from the data signal terminal to the control node in response to a control signal provided by the control signal terminal and a scan signal provided by the scan signal terminal; the driving sub-circuit is connected to the control node, a power signal terminal and a light-emitting element, respectively, and is used to drive the light-emitting element to emit light in response to a potential of the control node and a power signal provided by the power signal terminal;

each of the gate lines is connected to scan signal terminals of a row of the pixel circuits, each of the data lines is connected to data signal terminals of a column of the pixel circuits, each of the control signal lines is connected to control signal terminals of a column of the pixel circuits, and each of the power signal lines is connected to power signal terminals of a column of the pixel circuit;

the gate drive circuit is connected to the plurality of gate lines in the display substrate, and is used to provide scan signals to the plurality of gate lines connected to the gate drive circuit; and the source drive circuit is connected to the plurality of data lines and the plurality of control signal lines in the display substrate, respectively, and is used to provide data signals to the plurality of data lines connected to the source drive circuit, and to provide control signals to the plurality of control signal lines connected to the source drive circuit.

13. The display device according to claim 12, comprising a plurality of the gate drive circuits, wherein each of the gate drive circuits is connected to a switching-on signal terminal and a plurality of gate lines, respectively, and is used to provide scan signals in sequence to the plurality of gate lines connected to the gate drive circuit in response to a switching-on signal provided by the switching-on signal terminal connected to the gate drive circuit; and wherein different gate drive circuits are connected to different switching-on signal terminals, and different gate lines.

14. The display device according to claim 13, wherein the display substrate has a plurality of partitions, each of which comprises a plurality of rows of pixel units; and the plurality of gate lines connected to each of the gate drive circuits are connected to a plurality of rows of the pixel units in one of the partitions.

15. The display device according to claim 12, wherein the source drive circuit comprises a plurality of signal generation sub-circuits;

each of the signal generation sub-circuits is respectively connected to a clock signal terminal, at least one of the control signal lines and at least one of the data lines, respectively, and is used to output a control signal to the control signal line connected to the signal generation sub-circuit and output a data signal to the data line connected to the signal generation sub-circuit according to a clock signal provided by the clock signal terminal connected to the signal generation sub-circuit;

wherein the different signal generation sub-circuits are connected to different clock signal terminals, different control signal lines, and different data lines.

16. The display device according to claim 15, wherein each of the signal generation sub-circuits is respectively connected to the clock signal terminal, a plurality of adjacent control signal lines in the display substrate, and a plurality of adjacent data lines in the display substrate.

17. The display device according to claim 15, wherein each of the signal generation sub-circuits comprises a control signal generation portion and a data signal generation portion;

the control signal generation portion is connected to the clock signal terminal and at least one of the control signal lines, respectively, and is used to output control signals to the control signal lines connected to the control signal generation portion according to the clock signal provided by the clock signal terminal connected to the control signal generation portion; and the data signal generation portion is connected to the clock signal terminal and at least one of the data lines, respectively, and is used to output data signals to the data line connected to the data signal generation portion according to the clock signal provided by the clock signal terminal connected to the data signal generation portion.

18. The display device according to claim 17, wherein the control signal generation portion comprises: a flip-flop and an amplifier;

the flip-flop is connected to the clock signal terminal and the amplifier, respectively, and the amplifier is connected to at least one of the control signal lines.

19. The display device according to claim 12, wherein the display substrate comprises the control signal lines having a number the same as the number of the data lines, and the control signal lines are disposed in parallel with the data lines.

20. The display device according to claim 12, wherein one control signal line and one data line which are connected to each column of the pixel circuits are located at the same side of the column of pixel circuits.

* * * * *